US008434460B2

(12) United States Patent
Lin et al.

(10) Patent No.: US 8,434,460 B2
(45) Date of Patent: May 7, 2013

(54) INTEGRALLY MOLDED CARBON CANISTER

(75) Inventors: Jhun Lin, Novi, MI (US); Mark Edward Hipp, South Lyon, MI (US); Mohammad Usman, Northville, MI (US); Syed Ahmad, Canton, MI (US); Chris Kersman, Brighton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 307 days.

(21) Appl. No.: 12/916,120

(22) Filed: Oct. 29, 2010

(65) Prior Publication Data

US 2012/0103309 A1 May 3, 2012

(51) Int. Cl.
*F02M 33/02* (2006.01)
*F02M 33/04* (2006.01)

(52) U.S. Cl.
USPC ..... 123/519

(58) Field of Classification Search ..... 123/519, 123/518, 516, 520; 264/328.1; 137/43, 587, 137/588, 589
See application file for complete search history.

(56) References Cited

U.S. PATENT DOCUMENTS 4,569,816 A * 2/1986 Schiemann ..... 264/513
4,877,001 A * 10/1989 Kenealy et al. ..... 123/519
5,103,865 A * 4/1992 Hyde ..... 137/588
5,910,637 A * 6/1999 Meiller et al. ..... 96/135
6,816,820 B1 11/2004 Friedl et al.
6,955,159 B2 * 10/2005 Ogawa ..... 123/519
7,353,809 B2 * 4/2008 Peterson et al. ..... 123/516
2004/0226439 A1 * 11/2004 Heim et al. ..... 95/143
2006/0065252 A1 * 3/2006 Meiller et al. ..... 123/519
2007/0199547 A1 * 8/2007 Shears et al. ..... 123/518
2011/0315126 A1 * 12/2011 Yoshida et al. ..... 123/519

FOREIGN PATENT DOCUMENTS

CN 201275612 Y 7/2009
EP 0 099 104 B1 10/1987
WO 2007010286 A2 1/2007
WO 2008090324 A2 7/2008

* cited by examiner

*Primary Examiner* — Mahmoud Gimie
(74) *Attorney, Agent, or Firm* — Julia Voutyras; Alleman Hall McCoy Russell & Tuttle LLP

(57) ABSTRACT

An integrally molded carbon canister is provided. The integrally molded carbon canister includes a housing including four external side walls and an upper portion at least partially enclosing an internal cavity connected to a vapor inlet and outlet port, the upper portion including a depressed flow disruptor positioned rearward of an injection gate, and a first and second projected flow channel positioned adjacent to the injection gate and laterally spanning the housing. The depressed flow disruptor has a thickness that is less than a section of the upper portion surrounding the depressed flow disruptor and the projected flow channels have a thickness that is greater than a section of the upper portion surrounding the projected flow channels.

15 Claims, 6 Drawing Sheets

INTEGRALLY MOLDED CARBON CANISTER

BACKGROUND/SUMMARY

Carbon canisters are continually being refined to decrease cost and improve fuel vapor recovery. One area of improvement has been to incorporate various elements of the carbon canister into a single molded structure to decrease costs. For example, the vapor inlet, the vapor outlet, as well as the canister housing have been incorporated into a single integrally molded structure to reduce manufacturing cost.

However, when the geometric complexity of the carbon canister is increased, various problems may arise during molding. For example, the complexity of the mold may create pressure imbalances within the mold due to the flow patterns that are generated. The pressure imbalances may cause stress failure of the tooling structure. Moreover, structural weakness and other manufacturing defects in the carbon canister may develop when there is a substantial pressure differential between regions of the carbon canister during molding. In particular lower wall thickness, voids, short shots, and other molding defects may occur when there is a pressure imbalance during manufacturing.

As such, various example systems and approaches are described herein. In one example, an integrally molded carbon canister is provided. The integrally molded carbon canister includes a housing including four external side walls and an upper portion at least partially enclosing an internal cavity with a vapor inlet and outlet port, the upper portion including a depressed flow disruptor positioned rearward of an injection gate, and a first and second projected flow channel positioned adjacent to the injection gate point and laterally spanning the housing.

In some examples the carbon canister may further include ribs traversing at least a portion of three of the side walls forward of the injection gate. The ribs may extend between the upper portion and the at least three side walls and converge with the projected flow channels at a partition wall spanning the internal cavity dividing the internal cavity into a first and second chamber. The depressed flow disruptor may be interposed by an injection gate for the polymer melt during molding included in an upper portion of the housing and a partition wall separating the internal cavity into a first and second internal chamber.

In this way, the flow rate of the polymer melt may be adjusted to decrease the pressure differential between various portion of the carbon canister during molding, thereby reducing the degradation (e.g., wall thinning, warping, etc.,) caused by pressure imbalances. Moreover, the amount of manufacturing defects may be reduced and the structural integrity of the carbon canister may be increased when these type of flow-balancing features are utilized.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The integrally molded carbon canister including a plurality of elements is described here. The elements may include a depressed flow disruptor positioned rearward of an injection gate in an upper portion of the housing of the carbon canister. The elements may further include flow channels positioned adjacent to the injection gate and laterally spanning the housing. The elements may further include a plurality of ribs traversing at least a portion of three side walls included in the housing forward of the injection gate. The ribs extend between the upper portion of the housing and the three side walls. The depressed flow disruptor, projected flow channels, and ribs alter the flow of the polymer melt during molding of the carbon canister to decrease pressure differentials between various areas of the canister, thereby decreasing stresses on the mold. Thus, the longevity of the mold may be increased thereby decreasing manufacturing costs. Additionally, manufacturing defects such as wall thinning, short shots, etc., may also be decreased, thereby decreasing manufacturing costs and increasing manufacturing consistency. Furthermore, the ribs increase the structural integrity of the carbon canister decreasing the likelihood of durability failure of the carbon canister.

Figure 1:
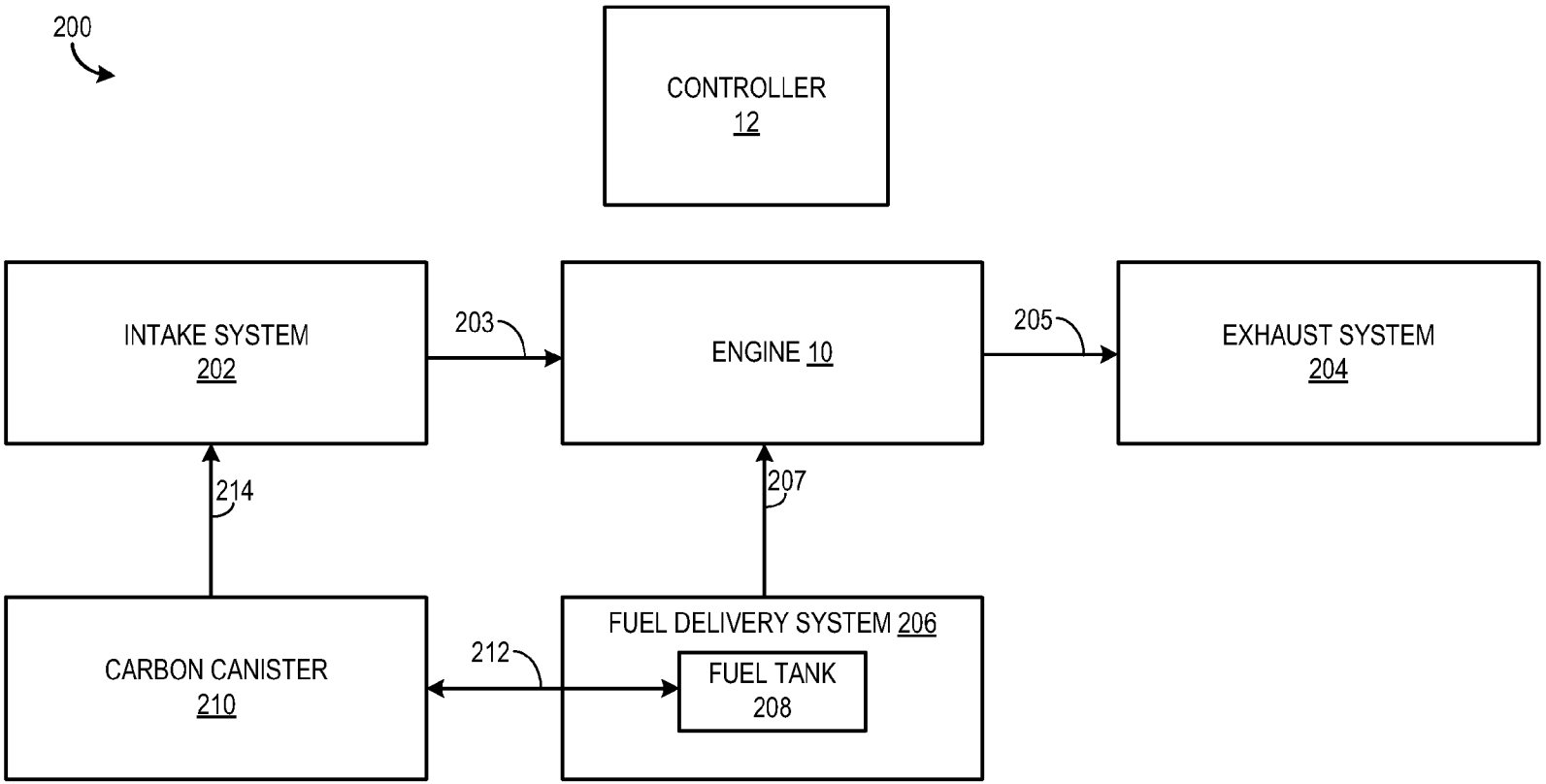
FIG. 1 shows a schematic depiction of a vehicle including an intake system, engine, and carbon canister.

FIG. 1 shows a schematic depiction of a vehicle 200. The vehicle includes an intake system 202 and an exhaust system 204 coupled to engine 10. Engine 10 may be configured to combust fuel. The intake system may be configured to provide engine 10 with intake gasses (e.g., air) and include various components such as throttle and intake manifold. Arrow 203 depicts the flow of air and/or other intake gasses into engine 10. Furthermore, arrow 205 depicts the flow of exhaust gasses from the engine into exhaust system 204. The exhaust system may include various components such as emission control device. As previously discussed suitable emission control devices may include, a catalytic convertor, a particulate filter, etc. In some examples the engine may be naturally aspirated. However, in other example the engine may be a forced induction engine including a turbocharger or supercharger. Other systems such as an exhaust gas recirculation (EGR) system may be employed to reduce emissions and improve performance within the vehicle.

A fuel delivery system 206 is coupled to engine 10. The fuel delivery system is configured to provide selected amounts of fuel to the engine. One or more pumps may be employed to enable injection of the fuel at a desired pressure via fuel injectors to the engine. Arrow 207 depicts the flow of fuel from the fuel delivery system to the engine. Engine 10 may employ direct injection, port injection, or a combination thereof. It will be appreciated that controller 12 may control the flow of fuel from the fuel delivery system to the engine. Controller 12 may be a microcomputer including: a microprocessor unit, input/output ports, read-only memory, random access memory, keep alive memory, a conventional data bus, etc. The fuel delivery system may further include a fuel tank 208 configured to store a suitable fuel such as gasoline, diesel, alcohol, bio-diesel, or a combination thereof. It will be appreciated that the fuel tank may be coupled to a fill cap or other suitable interface configured to enable refilling of the fuel tank via a fill tube.

The fuel delivery system may be coupled to a carbon canister 210. Although a carbon canister is depicted it will be appreciated that other suitable vapor canisters may be utilized. The carbon canister is configured to receive evaporative emissions (e.g., fuel vapor) from the fuel delivery system. Thus, arrow 212 depicts the flow of fuel vapor from the fuel tank to the carbon canister or visa-versa. It will be appreciated that during refueling fuel vapors may be sequestered to reduce and in some cases substantially inhibit evaporative emissions. Specifically, the fuel tank and/or the fill pipe may be supplied with a negative pressure to prevent fuel vapors from escaping into the surrounding atmosphere. Controller 12 may manage fuel vapor containment in the fuel delivery system.

It will be appreciated the carbon canister may be selectively purged via controller 12. In particular the carbon canister may be purged when a vacuum is present in the intake system. Thus arrow 214 represents the flow of fuel vapor from the carbon canister to the intake system. The purging strategy may be based on a number of factors such as engine speed, throttle position, engine temperature, etc. Additionally fuel vapors may be transferred to the carbon canister from the fuel delivery system (e.g., fuel tank) during selected operating conditions, such as refueling. In this way, evaporative emission from the vehicle may be reduced. It will be appreciated that one or more valves may be disposed within conduits coupling the carbon canister to the fuel tank and the intake system. The valves may be controlled by controller 12 to enable the aforementioned vapor control strategies.

Figure 2:
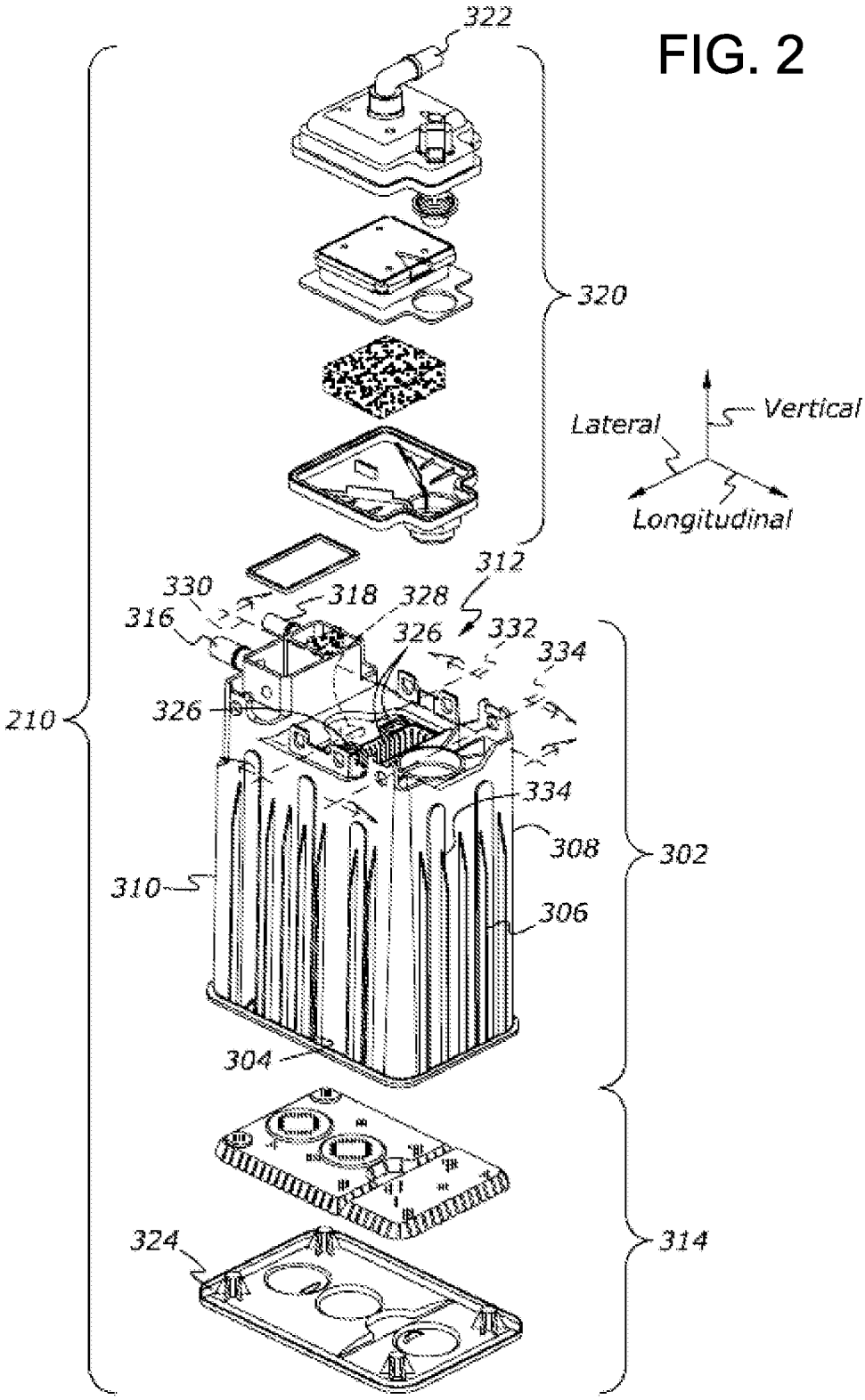
FIG. 2 shows a perspective view of an example carbon canister.

FIGS. 2-7 show various views of an example carbon canister drawn approximately to scale. In particular FIG. 2 shows an exploded perspective view of carbon canister 210. It will be appreciated that the coordinate axes are provided for descriptive purposes and the carbon canister may be orientated in any number of positions within the vehicle.

The carbon canister includes a housing 302. It will be appreciated that the housing is integrally molded. In other words a single mold may be used in an injection molding process to construct the carbon canister 210. The method used to construct the carbon canister is discussed in greater detail herein with regard to FIG. 9.

Housing 302 may include four external side walls (304, 306, 308, and 310) and an upper portion 312. However, other configurations may be utilized in other embodiments.

The upper portion includes various ports for vapor transport to and from carbon canister to other vehicle systems. In particular, the carbon canister includes a vapor inlet port 316 and a vapor outlet port 318. The vapor inlet and outlet ports are connected to internal cavity 401, shown in FIG. 3, at least partially enclosed by the four external side walls and the upper portion. Moreover, the vapor inlet and outlet ports may be connected to the first internal chamber 406, shown in FIG. 3, discussed in greater detail herein. However in other examples, the vapor inlet and outlet may be connected to additional or alternate internal chambers. The vapor inlet port may be coupled to the fuel tank in the fuel delivery system. On the other hand the vapor outlet port may be coupled to intake system 202 shown in FIG. 1. It will be appreciated that the vapor inlet port may be coupled to a valve configured to selectively permit the flow of fuel vapor from fuel tank 208 into carbon canister 210. Likewise the vapor outlet port may be coupled to a valve configured to selectively permit the flow of fuel vapor from carbon canister 210 to intake system 202. Further in some examples the valves may be integrated directly into the vapor inlet and outlet ports. In this way, the carbon canister may be operated to manage evaporative emission within the vehicle.

The carbon canister further includes a lower portion 314 having a cover 324 which substantially seals the bottom of the carbon canister from the surrounding environment when assembled. In other embodiments the lower portion may be integrated into housing 302 of the carbon canister.

Additionally the carbon canister includes a vent cap 320 having a vent conduit 322 in communication with the surrounding environment. The vent cap may be selectively sealed to test the carbon canister integrity. Specifically a vent valve (not shown) may be disposed within the vent cap for testing the carbon canister's integrity. The vent cap may be connected to the second and third internal chambers (408 and 410). Additionally or alternatively the vent cap may be connected to the first internal chamber 406.

Figure 3:
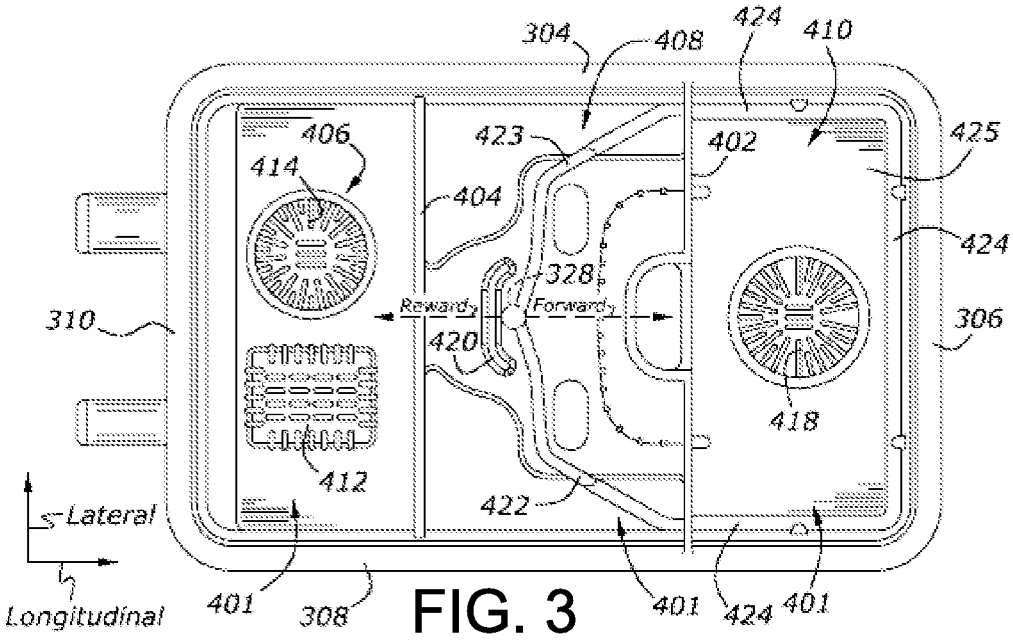
FIG. 3 shows a bottom view of the carbon canister shown in FIG. 2 with a lower portion of the carbon canister omitted.

The carbon canister may further include a plurality of opening 326 connecting an internal cavity 401, shown in FIG. 3, to the vent cap of the carbon canister. Cutting plane 330 defines the cross-section shown in FIG. 4. Cutting plane 332 defines the cross section shown in FIG. 5. Cutting plane 334 defines the cross-section shown in FIG. 6.

FIG. 3 shows a cross-sectional bottom view of carbon canister 210. As shown the carbon canister includes an internal cavity 401 defined by the external side walls (304, 306, 308, and 310), upper portion 312 and lower portion 314. A first partition wall 402 and a second partition wall 404 may span the internal cavity dividing the cavity into a first, second, and third internal chamber (406, 408, and 410). However in other embodiments the carbon canister may include a single partition wall dividing the cavity into a first and second internal chamber. As shown, the partition walls are equally spaced in a lateral direction from the external side walls (306 and 310). However, in other examples, other layouts are possible. The partition walls extend vertically through the canister. It will be appreciated that the partition walls are substantially planar. However, the partition walls may have other geometries in other embodiments. Additionally, the first and second partition walls (402 and 404) are parallel to external side walls 306 and 310 and adjacent to the vapor inlet port and the vapor outlet port. However, the partition walls may have an alternate geometry and/or position in other embodiments.

A first slot screen filters 412, shown in FIG. 3, may be positioned in upper portion 312 coupled to the vapor inlet port 316. Likewise a second slot screen filter 414 may be positioned in the upper portion coupled to the vapor outlet port 318. A third slot screen filter 418 may also be disposed in upper portion 312 of the housing interfacing with the vent cap. The slot screen filters may be configured to decrease the amount unwanted particulates entering or exiting the carbon canister.

In some examples, each chamber within the carbon canister may be mass transportation capable. However in other examples, two or more of the chambers within the carbon canister may be isolated. A suitable material configured to absorb fuel vapor, such as active charcoal is disposed in one or more of the internal chambers.

During molding of carbon canister 210 an injection gate may provide an inlet for a polymer melt (e.g., liquid polymer). The injection gate is depicted with dashed circle 328, in FIG. 2. Although the injection gate is depicted with a circular geometry other non-circular geometries may be utilized in other embodiments. As illustrated the injection gate is interposed by the first and second partition walls (402 and 404). It will be appreciated that when the injection gate is positioned in this manner during molding the pressure differential between different locations within the mold may be decreased. In this way, stresses on the mold may be reduced, thereby increasing the mold's longevity. Moreover, manufacturing defects may also be reduced when the pressure differential is decreased.

Returning to FIG. 3, as shown carbon canister 210 includes a depressed flow disruptor 420 configured to increase the turbulent and/or frictional energy losses within the polymer melt during molding. The depressed flow disruptor may be positioned reward of injection gate 328. It will be appreciated that forward and reward correspond to positions on longitudinal coordinate axis illustrated in FIGS. 2, 3, and 4.

The depressed flow disruptor includes a depressed section of upper portion 312. The depressed portion may create an obstruction for the polymer melt during molding of the carbon canister, thereby increasing the flow in the desired portion. In this way the polymer melt's flow rate to peripheral portions of the carbon canister may be decreased which in turn may facilitate a decreased pressure differentials within the mold.

Figure 4:
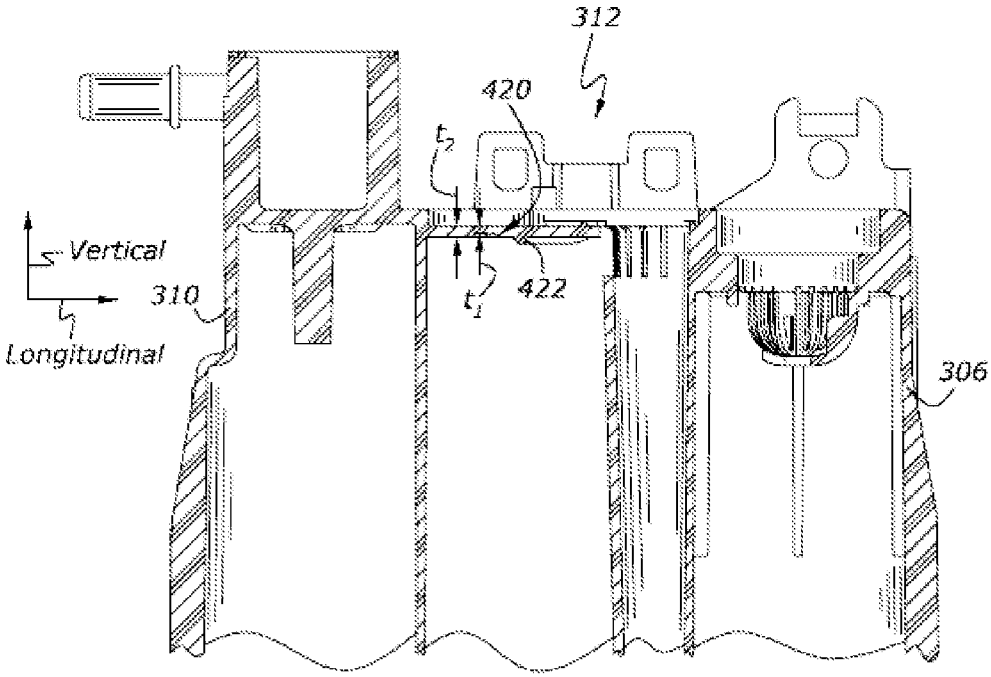
FIGS. 4-6 show various cross-sectional views of the carbon canister shown in FIG. 2.
Figure 5:
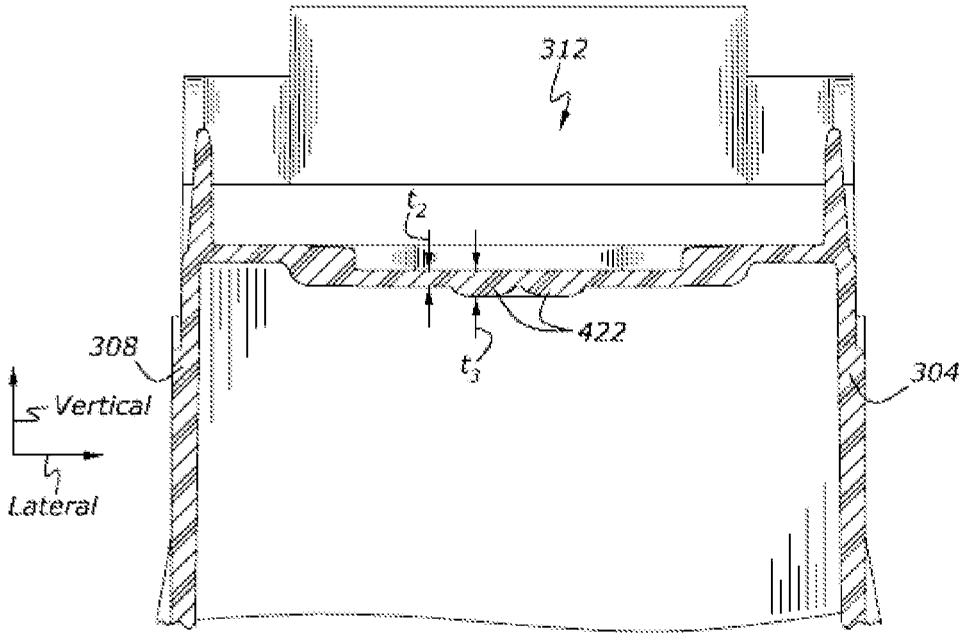

Now referring to FIG. 4, the depressed flow disruptor may have a thickness that is less than the thickness of the upper portion 312 surrounding depressed flow disruptor 420. In particular, depressed flow disruptor 420 may have a thickness ($t_1$) between 1.6 millimeters (mm) to 2.5 mm. The ratio between the thickness ($t_2$) of a section the upper portion of carbon canister and the thickness ($t_1$) of the depressed flow disruptor may be between 0.6 to 0.9. It will be appreciated that when the ratio is within this range the pressure of the fluid adjacent to the depressed flow disruptor is decreased to a desired level during molding. The desired level may be selected based on the material properties of the polymer melt, the part geometry and processing conditions during molding, etc. As illustrated the depressed flow disruptor is curved. Additionally, the depressed flow disruptor is interposed between the first and second partition walls (402 and 404). However other flow disruptor geometries and positions are possible. Returning to FIG. 3, carbon canister 210 further includes a first projected flow channel 422 and a second projected flow channel 423 extending towards opposing walls from injection gate 328, shown in FIG. 2. As shown the projected flow channels are extrusions extending towards side walls (304 and 308) laterally spanning housing 302. Additionally, the projected flow channels are interposed between the first and second partition walls (402 and 404). However, other flow channel positions are possible. It will be appreciated that the projected flow channels help balance the flow during molding due to the increase in the cross-sectional area of the flow channel. In this way, the flow channel may provide an increased amount of polymer melt to part of the mold spaced away from the injection gate. In particular the projected flow channels increase the amount of polymer melt delivered to walls (304 and 310) as well as partition wall 402 during molding. Specific layout is highly dependent on the application under consideration and can be determined by using simulation tools such as Moldflow. FIG. 5 shows a cross-sectional view of the projected flow channels 422 and 423. As shown the projected flow channels have a thickness ($t_3$) that is greater than the thickness ($t_2$) of a section of the upper portion 312 surrounding the projected flow channels. In some examples, the ratio between $t_2$ and $t_3$ may be more than 0.60. Projected flow channels 422 and 423 may be coupled to ribs 424 at least partially extending around a periphery of an internal chamber defined by partition wall 402 and external side walls (304, 306, and 310). In this way the ribs traverse the third internal chamber 410.

Figure 6:
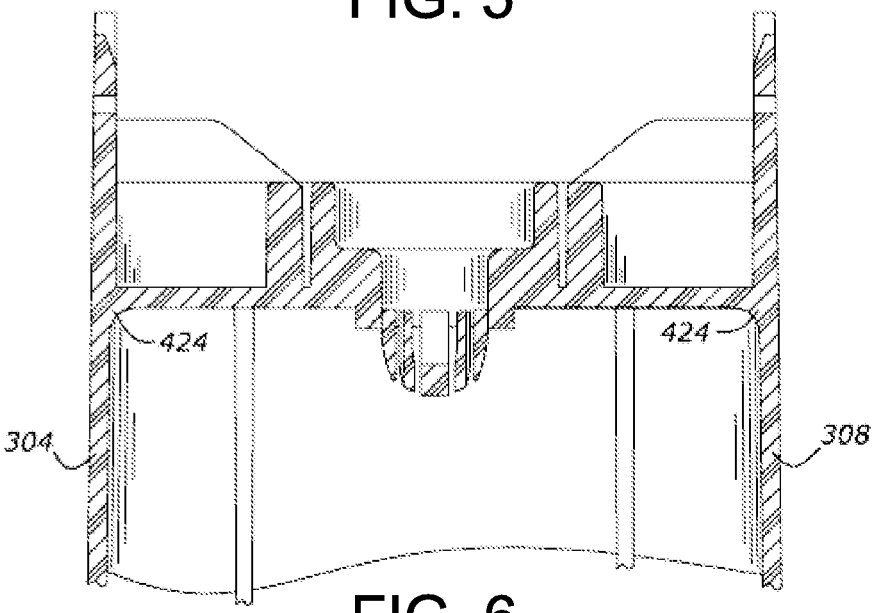

Specifically the ribs and the projected flow channels (422 and 423) converge at partition wall 402 spanning internal cavity 401. The ribs are positioned forward of injection gate point 328, shown in FIG. 2, and spaced away from depressed flow disruptor 420. Additionally, the ribs extend between a wall 425 included in upper portion 312 and the external side walls 304, 306, and 310. A side view of the ribs is shown in FIG. 6. As shown the ribs have curvature. In some examples the curvature may be circular.

However, in other examples other geometries are possible. The ribs are configured to increase flow during molding and provide structural rigidity to canister. In this way, a greater amount of polymer melt is provided to external side walls 304, 306, and 310 during molding. It will be appreciated that the ribs may also increase the structural integrity of the carbon canister, decreasing the likelihood of canister durability failure due to increased internal pressure. Moreover, it will be appreciated that injection gate 328 is interposed by depressed flow disruptor 420 and ribs 424.

The geometry (e.g., size, shape) of the depressed flow disruptor, projected flow channels, and ribs may be selected to reduce the pressure differential of the polymer melt in the carbon canister during molding. In particular the width of the depressed flow disruptor may be increased to increase the flow during molding, thereby decreasing the amount of polymer melt provided to side wall 310 during molding. Furthermore, the height and width of the ribs may be increased to increased amount of polymer melt to external side walls 304, 306, and 310 during molding. The size and geometry of the ribs may be selected based on the size and geometry of the carbon canister housing. For example, the size of the ribs may be increased if the width of the external side walls adjacent to the ribs is increased. Likewise, the size of the ribs may be decreased if the size of the external side walls adjacent to the ribs is decreased. In some examples, the ribs 424 should be ½ to ⅔ of the nominal wall thickness and less than 3 times thickness in height. Further in some examples, the ribs may have a taper of 1 degree. It will be appreciated that excess rib thickness may promote shrinkage. Moreover, excess rib height with taper may produce thin sections requiring extended cycle time increasing the part cost. It will be appreciated that the position and geometry of depressed flow disruptor 420, projected flow channels (422 and 423), and ribs 424 may be selected such that the pressure differential between a first and a second area in the carbon canister is decreased during molding. Moreover, it will be appreciated that when the depressed flow disruptor, projected flow channels, and ribs are not included in the carbon canister a polymer melt (e.g., liquid polymer) may reach the two partition walls as well as external side wall 310 prior to reaching external side wall 306 during molding. Therefore, a pressure imbalance develops in the molding, which may fatigue the cores as well as increase the likelihood of manufacturing defects such as thin walls, sink marks, short shots, etc.

Figure 7:
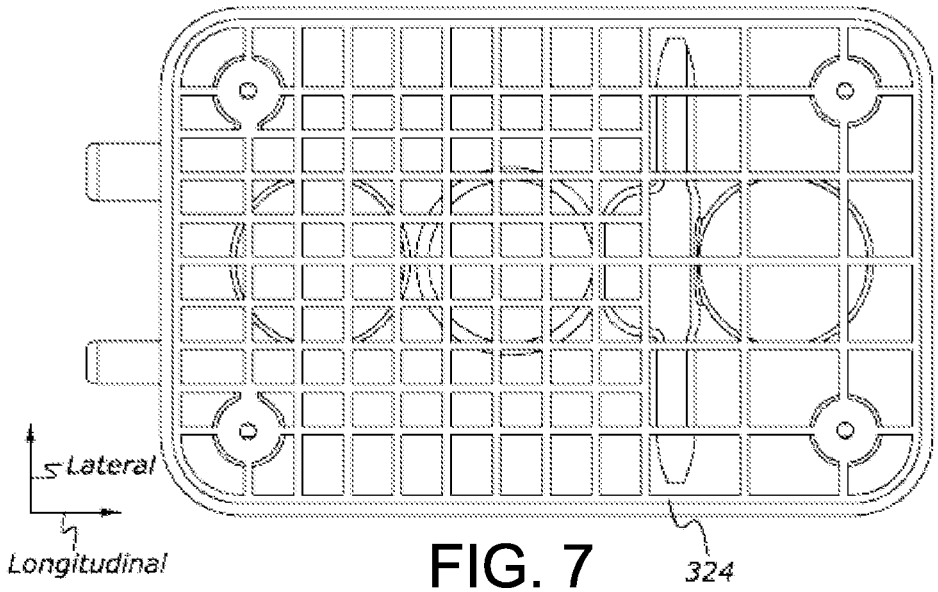
FIG. 7 shows another bottom view of the carbon canister shown in FIG. 2.
Figure 8:
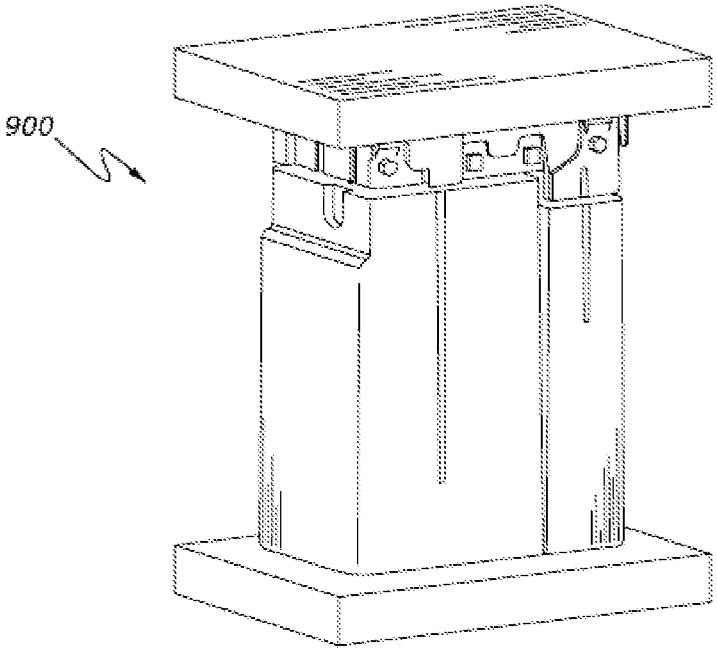
FIG. 8 shows a mold that may be used to manufacture the carbon canister shown in FIG. 2.

FIG. 7 shows a view of the bottom of carbon canister 210 when assembled and FIG. 8 shows a mold 900 for molding the carbon canister shown in FIGS. 2-7. It will be appreciated that a polymer melt may be injected into mold 900 via a gate to construct the carbon canister shown in FIGS. 2-7. It will be appreciated that when mold 900 is used to create carbon canister 210 the longevity of the mold may be increased, as discussed above.

Figure 9:
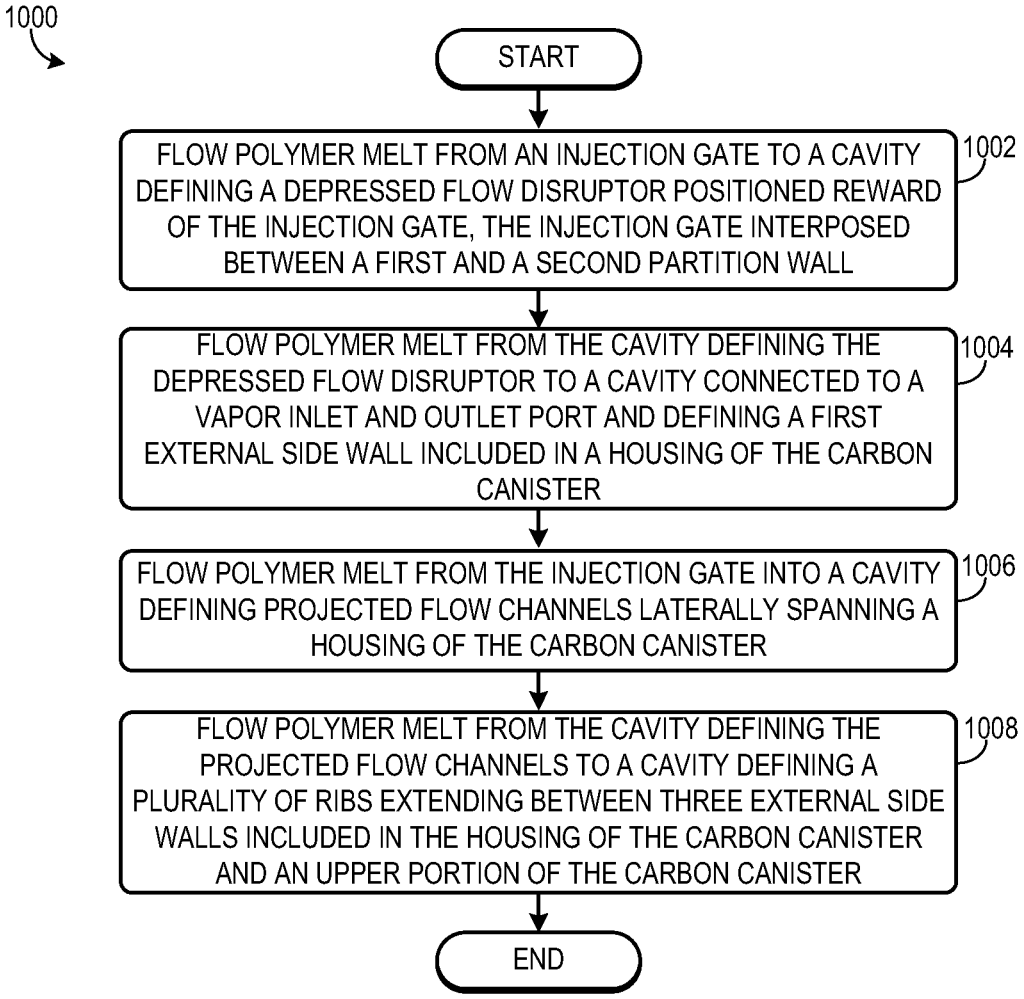
FIG. 9 shows a method for manufacture of a carbon canister.

FIG. 9 shows a method 1000 for manufacture of an integrally molded carbon canister. Method 1000 may be carried out by the systems and components described above. However, method 1000 may be implemented by other suitable systems and components in other embodiments.

First at 1002 the method includes flowing polymer melt from an injection gate to a cavity defining a depressed flow disruptor positioned reward of the injection gate, the injection gate interposed between a first and a second partition wall As previously discussed the depressed flow disruptor may be curved. At 1004 the method further includes flowing polymer melt from the cavity defining the depressed flow disruptor to a cavity connected to a vapor inlet and outlet port and defining a first external side wall included in a housing of the carbon canister Next at 1006 the method includes flowing polymer melt from the injection gate into a cavity defining projected flow channels laterally spanning a housing of the carbon canister. At 1008 the method includes flowing polymer melt from the cavity defining the projected flow channels to a cavity defining a plurality of ribs extending between three external side walls included in the housing of the carbon canister and an upper portion of the carbon canister. As previously discussed the ribs may be positioned between three external side walls of the housing and an upper portion of the housing and the ribs and the first and second flow channels may converge at the first partition wall. In this way, flow of polymer melt may be reduced in a first portion of the canister and increased in a second portion of the canister via the flow balancing features (i.e., depressed flow disruptor and ribs), thereby decreasing the pressure differential between the first and second portions of the canister during molding. The longevity of the mold is increased while decreasing manufacturing defects (e.g., thin wall, sink marks, etc.,) caused by pressure differentials within the mold. Moreover, the ribs may also increase the structural integrity of the carbon canister, decreasing the likelihood of structural failure or degradation due to elevated pressures.

The systems and methods described herein enables the pressure differential between various locations within the mold to be decreased during molding, thereby reducing the stress on the mold as well as decreasing the likelihood of manufacturing defects within the mold. In this way the manufacturing cost of the carbon canister may be decreased.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

The invention claimed is:

1. An integrally molded carbon canister, comprising:

a housing including four external side walls and an upper portion at least partially enclosing an internal cavity connected to a vapor inlet and outlet port, the upper portion including a depressed flow disruptor positioned rearward of an injection gate, and a first and second projected flow channel positioned adjacent to the injection gate and laterally spanning the housing;

wherein the depressed flow disruptor has a thickness that is less than a section of the upper portion surrounding the depressed flow disruptor and the projected flow channels have a thickness that is greater than a section of the upper portion surrounding the projected flow channels.

2. The integrally molded carbon canister of claim 1, wherein the depressed flow disruptor is curved.

3. The integrally molded carbon canister of claim 1, further comprising ribs traversing at least a portion of three of the side walls forward of the injection gate.

4. The integrally molded carbon canister of claim 3, wherein the ribs extend between the upper portion and the at least three side walls.

5. The integrally molded carbon canister of claim 4, wherein the ribs and the projected flow channels converge at a partition wall spanning the internal cavity dividing the internal cavity into a first and second chamber.

6. The integrally molded carbon canister of claim 1, wherein the carbon canister includes a first and a second partition wall, the injection gate interposed between the first and second partition walls.

7. The integrally molded carbon canister of claim 6, wherein the depressed flow disruptor and the first and second projected flow channels are interposed between the first and second partition walls.

8. The integrally molded carbon canister of claim 6, wherein the first and second partition walls are parallel to an external side wall adjacent to the vapor inlet port and the vapor outlet port.

9. The integrally molded carbon canister of claim 3, wherein the ribs are spaced away from the depressed flow disruptor.

10. An integrally molded thermoplastic carbon canister for a vehicle including an intake system and an engine, comprising:

a housing including four external side walls, an upper portion at least partially enclosing an internal cavity connected with a vapor inlet and outlet port, and a first partition wall and a second partition wall dividing the internal cavity into a first, second, and third internal chamber, the upper portion including a depressed flow disruptor positioned rearward of an injection gate and interposed between the first and second partition walls, a first projected flow channel and a second projected flow channel laterally spanning the housing, and ribs extending between the upper portion and at least three of the external side walls, the ribs and the first and second projected flow channels converge at the first partition wall;

wherein the depressed flow disruptor has a thickness that is less than a section of the upper portion surrounding the depressed flow disruptor and the projected flow channels have a thickness that is greater than a section of the upper portion surrounding the projected flow channels.

11. The integrally molded thermoplastic carbon canister of claim 10, wherein the vapor inlet port and vapor outlet port are coupled to the first internal chamber, the injection gate is adjacent to the second internal chamber, and the ribs traverse the third internal chamber.

12. The integrally molded thermoplastic carbon canister of claim 10, wherein the depressed flow disruptor is curved.

13. The integrally molded thermoplastic carbon canister of claim 10, wherein the ribs are spaced away from the depressed flow disruptor.

14. The integrally molded thermoplastic carbon canister of claim 10, wherein the first and second partition walls are parallel to an external side wall adjacent to the vapor inlet port and the vapor outlet port.

15. An integrally molded thermoplastic carbon canister for a vehicle, comprising:

an upper portion at least partially enclosing an internal cavity connected to a vapor inlet and outlet port, the upper portion including a depressed flow disruptor positioned rearward of an injection gate, and a first and second projected flow channel positioned adjacent to the injection gate and laterally spanning a housing, the flow disruptor and the projected flow channels having unequal thicknesses.

* * * * *